US007524172B2

(12) United States Patent
Lee et al.

(10) Patent No.: US 7,524,172 B2
(45) Date of Patent: Apr. 28, 2009

(54) VIBRATION REDUCTION STRUCTURE OF RECIPROCATING COMPRESSOR

(75) Inventors: Hyo-Jae Lee, Gyeongsangnam-Do (KR); Dong-Won Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 541 days.

(21) Appl. No.: 11/050,697

(22) Filed: Feb. 7, 2005

(65) Prior Publication Data

US 2005/0175474 A1 Aug. 11, 2005

(30) Foreign Application Priority Data

Feb. 10, 2004 (KR) ..... 10-2004-0008750

(51) Int. Cl.
*F04B 39/00* (2006.01)

(52) U.S. Cl. ..... 417/312; 417/540; 417/572; 181/403

(58) Field of Classification Search ..... 417/540, 417/363, 416, 545, 312, 572; 181/403
See application file for complete search history.

(56) References Cited

U.S. PATENT DOCUMENTS 6,537,041 B2 * 3/2003 Lee ..... 417/415

FOREIGN PATENT DOCUMENTS

CN 1374454 A 10/2002
JP 56-964 U 1/1981
JP 57-180173 U 11/1982
JP 63-44626 U 3/1988
JP 9-144661 A 6/1997
JP 2000-120535 A 4/2000
JP 3-18632 U 10/2007

* cited by examiner

*Primary Examiner*—Charles G Freay
(74) *Attorney, Agent, or Firm*—Birch, Stewart, Kolasch & Birch, LLP

(57) ABSTRACT

A vibration reduction structure of a reciprocating compressor comprises: a case having a suction pipe for introducing a refrigerant and a discharge pipe for discharging a refrigerant at both sides thereof; an assembly installed in the case to compress a refrigerant and composed of a cylinder, a piston, a driving unit, and a discharge valve assembly; a loop pipe installed between the discharge valve assembly and the discharge pipe with a curved shape; and a connection unit for connecting a first point of the loop pipe and a second point of the loop pipe facing the first point and thereby reducing a vibration transmission. According to this, vibration generated as the piston is operated can be transmitted to the compressor through many paths including the loop pipe and the additional connection unit. Also, generated vibration can be canceled to each other due to its phase difference, thereby preventing vibration from being transmitted to the entire case. Also, a damage of the connection part of the loop pipe due to vibration can be prevented, and a reliability of the product can be enhanced.

9 Claims, 2 Drawing Sheets

VIBRATION REDUCTION STRUCTURE OF RECIPROCATING COMPRESSOR

BACKGROUND OF THE INVENTION

1. Field of the Invention

The present invention relates to a vibration reduction structure of a reciprocating compressor capable of preventing vibration generated from an assembly composed of a piston, a cylinder, and a driving unit from being transmitted to an entire case at the time of operating the compressor, and more particularly, to a vibration reduction structure of a reciprocating compressor capable of effectively reducing vibration by installing a loop pipe between an assembly and a case and installing an additional connection unit at the loop pipe in order to discharge a compressed refrigerant.

2. Description of the Conventional Art

Generally, a compressor is a device for enhancing a pressure by compressing various gas such as air, refrigerant, etc. by receiving power from a power generating device such as an electric motor, a turbine, etc. The compressor is being widely used in home appliances such as a refrigerator, an air conditioner, etc. or throughout the industry.

The compressor can be classified into a reciprocating compressor for compressing a refrigerant as a piston is linearly reciprocated in a cylinder with forming a compression space for sucking and discharging operation gas between the piston and the cylinder; a rotary compressor for compressing a refrigerant as a roller is eccentrically-rotated along an inner wall of a cylinder with forming a compression space for sucking and discharging operation gas between the eccentrically rotated roller and the cylinder; and a scroll compressor for compressing a refrigerant as an orbiting scroll is rotated along a fixed scroll with forming a compression space for sucking and discharging operation gas between the orbiting scroll and the fixed scroll.

Recently, among the reciprocating compressors, a linear compressor having a simplified structure and capable of enhancing a compression efficiency without a mechanical loss due to a motion conversion by directly connecting a piston to a linearly-reciprocating driving motor is being much developed.

FIG. 1 is a lateral section view showing a reciprocating compressor in accordance with the conventional art.

As shown, the general reciprocating compressor compresses operation fluid such as refrigerant, etc. as a piston is linearly reciprocated in a cylinder. FIG. 1 shows a linear compressor among the reciprocating compressor. The reciprocating compressor comprises: a case 2 to which a suction pipe 30 for introducing a refrigerant and a discharge pipe 31 for discharging a refrigerant are connected; a cylinder 4 installed in the case 2; a piston 6 linearly-reciprocated in the cylinder 4, for sucking a refrigerant into a compression space P, compressing, and then discharging the refrigerant; a driving unit 10 fixed to an outer side of the cylinder 4, for linearly-reciprocating the piston 6; a suction valve 24 installed at one end of the piston 6 that forms the compression space P, for sucking a refrigerant to the compression space P; and a discharge valve assembly 20 installed at one end of the cylinder 4 that forms the compression space P, for discharging a refrigerant from the compression space P to the discharge pipe 31.

The cylinder 4 is formed as a hollow type so that the piston 6 can be linearly-reciprocated therein, and is provided with the discharge valve assembly 20 at one end thereof.

The piston 6 is provided with a refrigerant channel 7 at a center thereof so that a refrigerant introduced from the suction pipe 30 can flow, and is inserted into the cylinder 4 thereby to form a compression space P at one side thereof. Also, one end of the piston 6 is elastically supported by a supporting frame 26 separately installed from the cylinder 4 by restoration springs 8 and 9 installed in an axial direction.

The driving unit 10 is composed of: a cylindrical inner stator 12 fixed to an outer side of the cylinder 4 and formed as a plurality of lamination sheets 11 are laminated in a circumferential direction; a cylindrical outer stator 14 installed at an outer side with a certain interval and formed as a plurality of lamination sheets 17 are laminated on an outer side of a coil 15 in a circumferential direction; and a permanent magnet 16 installed between the inner stator 12 and the outer stator 14 and connected to another end of the piston 6 by a mounting member 18.

The inner stator 12 and the outer stator 14 are fixed to an outer side of the cylinder 4 by a frame 19, and the permanent magnet 16 is installed to be linearly-reciprocated with the mounting member 18 and the piston 6.

The suction valve 24 is formed as a thin plate shape and a center portion thereof is positioned at one end of the piston 6. The center portion of the suction valve 24 is partially cut to open and close the refrigerant channel 7, and one side of the suction valve 24 is fixed to one end of the piston 6 by a screw.

The discharge valve assembly 20 is composed of: a discharge cover 21 installed to form a discharge space O at a side of one end of the cylinder 4; a discharge valve 22 for opening and closing one end of the of the cylinder 4; and a valve spring 23 installed between the discharge cover 21 and the discharge valve 22, for providing an elastic force in an axial direction.

A curved loop pipe 28 is installed between one side of the discharge cover 21 and the discharge pipe 31. The loop pipe 28 guides a compressed refrigerant to be discharged outwardly, and prevents vibration generated by a reciprocal operation among the cylinder 4, the piston 6, and the driving unit 10 from being transmitted to the entire case 2.

FIG. 2 is a perspective view showing the loop pipe of the reciprocating compressor in accordance with the conventional art. When a natural frequency of the loop pipe 28 is equal or similar to an operation frequency of the piston 6, a resonance is occurred. Therefore, in order to prevent the resonance occurrence, the loop pipe 28 is designed to have a natural frequency that is not equal or is not similar to the operation frequency of the piston 6, thereby preventing vibration and noise from being transmitted to the case 2.

The cylinder 4, the piston 6, the driving unit 10, and an oil supplying device 40 are connected to one another thereby to form an assembly. The assembly is installed in the case 2 to be supported by a buffering device such as a supporting spring 29, etc.

The oil supplying device 40 for supplying oil stored at an inner lower side of the case 2 to a space between the piston 6 and the cylinder 4 is installed at a lower side of the frame 19, thereby preventing a friction between the piston 6 and the cylinder 4 and cooling the cylinder 4.

In the conventional vibration reduction structure for the scroll compressor, the loop pipe 28 for guiding a refrigerant to be discharged is installed between the assembly and the discharge pipe 31, and the assembly is supported by a buffering device such as the supporting spring 29, etc. at the lower side of the case 2, thereby reducing vibration.

Since the loop pipe 28 is curvedly formed so that a vibration transmission path can be longer, vibration generated from the assembly is reduced while being transmitted along the loop pipe 28. At this time, the supporting spring 29 reduces vibration generated from the assembly in the up-down direction.

In the conventional vibration reduction structure for the reciprocating compressor, since the loop pipe 28 is curvedly formed to be welded to the discharge cover 21 and the discharge pipe 31, a vibration transmission path becomes long and thereby a vibration transmission to the case 2 is reduced. However, there is a limit in making the loop pipe 28 long. Also, in case that the loop pipe becomes different from the original design condition due to various changes of an operation frequency of the driving unit 10 or various external influences, etc., a resonance is occurred and vibration having a comparatively great displacement is generated at a specific part of the loop pipe. The generated vibration is transmitted to the connection part of the loop pipe and thus the connection part is destroyed, thereby degrading a reliability of the product.

SUMMARY OF THE INVENTION

Therefore, an object of the present invention is to provide a vibration reduction structure of a reciprocating compressor capable of preventing vibration generated when a piston is driven from being transmitted to an entire case by transmitting the vibration through many paths.

To achieve these and other advantages and in accordance with the purpose of the present invention, as embodied and broadly described herein, there is provided a vibration reduction structure of a reciprocating compressor comprising: a case having a suction pipe for introducing a refrigerant and a discharge pipe for discharging a refrigerant at both sides thereof; a cylinder installed in the case; a piston linearly-reciprocated in the cylinder and forming a compression space, for introducing a refrigerant into the compression space in an axial direction and compressing the refrigerant; a driving unit for linearly-reciprocating the piston; a discharge valve assembly installed at an end of the compression space of the cylinder to be opened and closed, for discharging a compressed refrigerant; a loop pipe installed between the discharge valve assembly and the discharge pipe with a curved shape, for preventing vibration generated from the cylinder, the piston, and the driving unit from being transmitted to the case; and a connection unit for connecting a first point of the loop pipe and a second point of the loop pipe adjacent to the first point and thereby reducing a vibration transmission.

The connection unit is preferably a clip having a hook at both ends thereof, respectively so that one end thereof can be hooked at the first point of the loop pipe and another end thereof can be hooked at the second point of the loop pipe.

More preferably, the hook of one end of the clip is formed to wind the first point of the loop pipe in a forward direction, and the hook of another end of the clip is formed to wind the second point of the loop pipe in a backward direction.

The connection unit can be constructed as a coil spring that one end thereof is hooked at the first point of the loop pipe and another end thereof is hooked at the second point of the loop pipe, or can be constructed as a wire to wind the first point and the second point of the loop pipe several times.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of the present invention will be explained with reference to the attached drawings as follows.

A vibration reduction structure of a reciprocating compressor according to the present invention comprises: a case having a suction pipe for introducing a refrigerant and a discharge pipe for discharging a refrigerant at both sides thereof; a cylinder installed in the case; a piston linearly-reciprocated in the cylinder and forming a compression space, for introducing a refrigerant into the compression space in an axial direction and compressing the refrigerant; a driving unit for linearly-reciprocating the piston; a discharge valve assembly installed at an end of the compression space of the cylinder to be opened and closed, for discharging a compressed refrigerant; a loop pipe installed between the discharge valve assembly and the discharge pipe with a curved shape, for preventing vibration generated from the cylinder, the piston, and the driving unit from being transmitted to the case; and a connection unit for connecting a first point of the loop pipe and a second point of the loop pipe adjacent to the first point and thereby reducing a vibration transmission.

The connection unit connects a first point of the loop pipe 28 to a second point of the loop pipe 28 facing the first point.

It is preferable that a plurality of the connection unit are formed.

Figure 1:
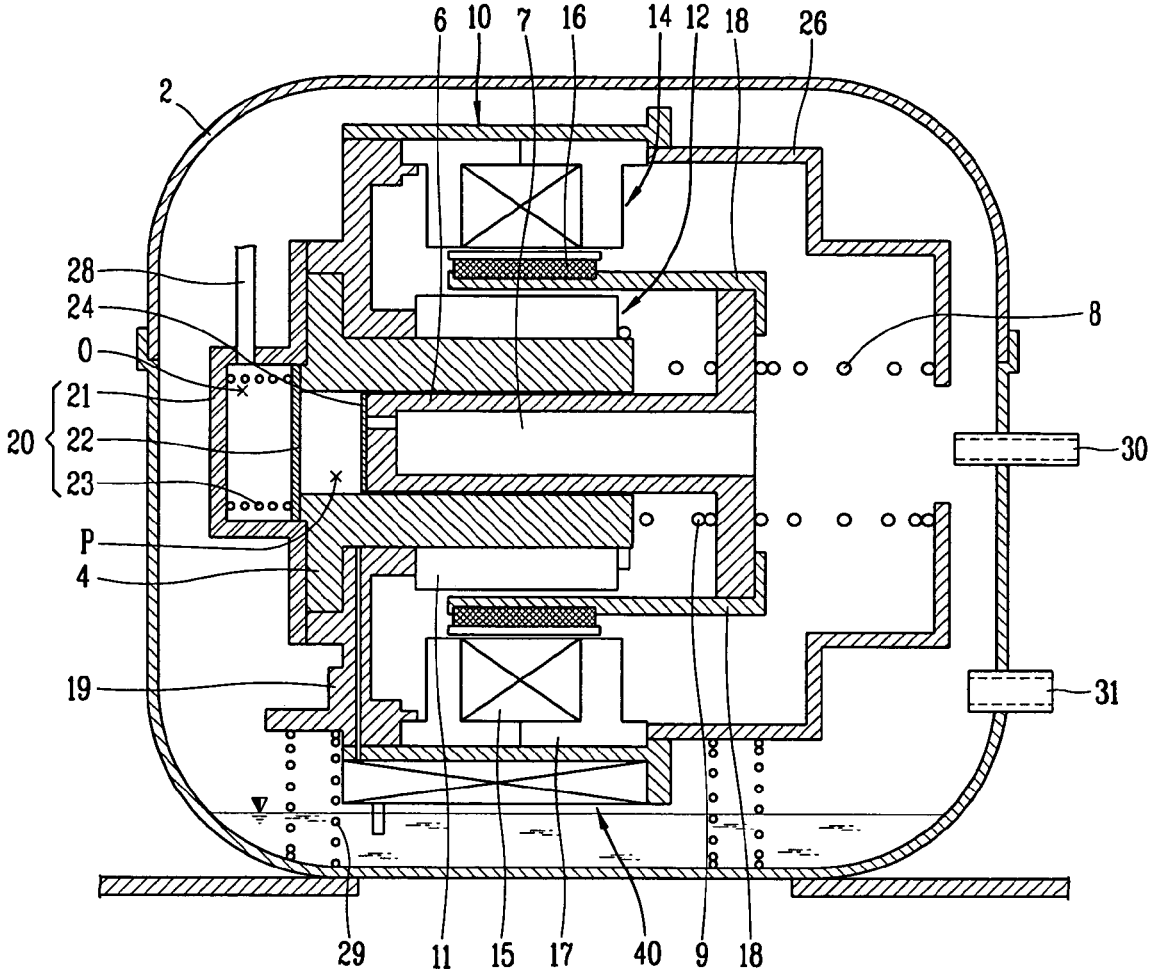
FIG. 1 CONVENTIONAL ART
FIG. 1 is a lateral section view showing a reciprocating compressor in accordance with the conventional art.
Figure 2:
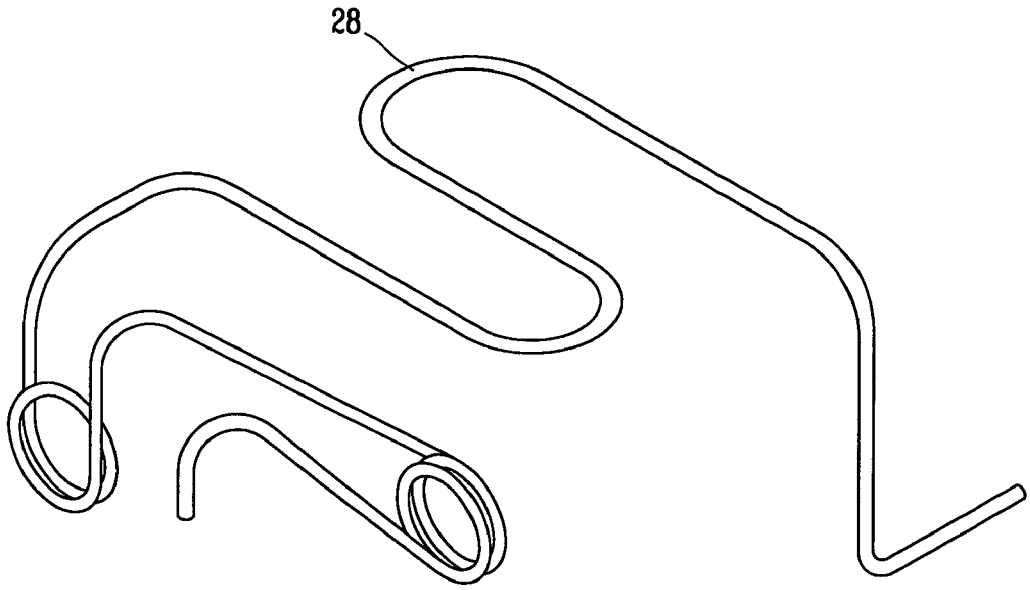
FIG. 2 CONVENTIONAL ART
FIG. 2 is a perspective view showing a loop pipe of the reciprocating compressor in accordance with the conventional art.
Figure 3:
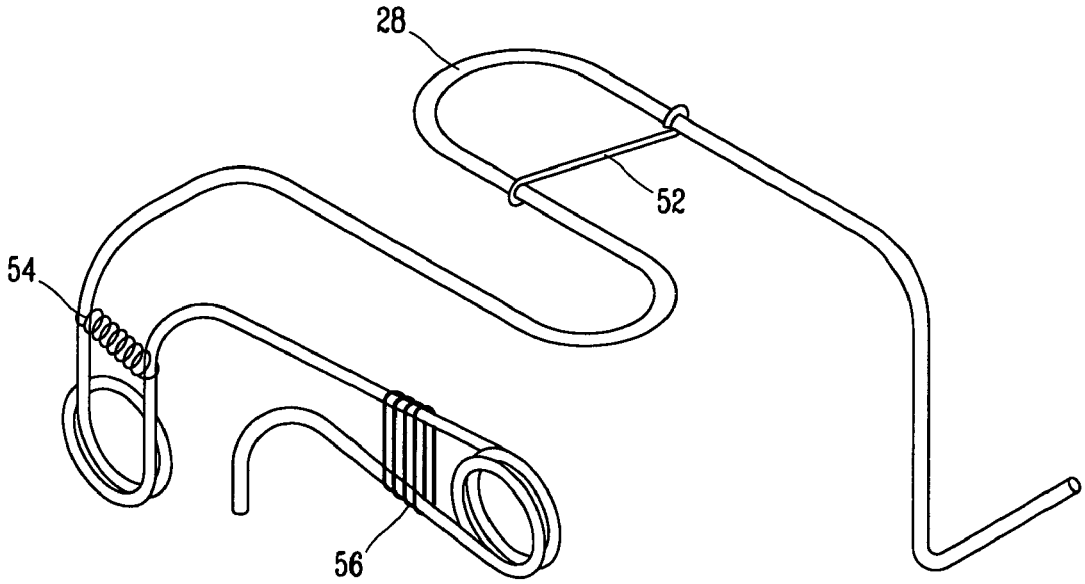
FIG. 3 is a perspective view showing preferred embodiments of a connection unit of the present invention.

FIG. 3 is a perspective view showing preferred embodiments of the connection unit of the present invention. The above three embodiments can be applied together one another or individually.

The connection unit 52 is preferably a clip having a hook at both ends thereof, respectively so that one end thereof can be hooked at the first point of the loop pipe 28 and another end thereof can be hooked at the second point of the loop pipe 28.

More preferably, the hook of one end of the connection unit 52 is formed to wind the first point of the loop pipe 28 in a forward direction, and the hook of another end of the connection unit 52 is formed to wind the second point of the loop pipe 28 in a backward direction.

As a modification example, the connection unit 54 is a coil spring that one end thereof is hooked at the first point of the loop pipe 28 and another end thereof is hooked at the second point of the loop pipe 28. As the coil spring, a compression coil spring for providing a compression force in a longitudinal direction can be used, or a tension coil spring for providing a tensile force in a longitudinal direction can be used.

As still another embodiment, the connection unit 56 is installed to wind the first point and the second point of the loop pipe 28 several times. The connection unit 56 is preferably constructed as a wire.

The operation and effects of the present invention will be explained as follows.

First, power is applied to the outer stator 14. According to this, the permanent magnet 16 is moved by a reciprocal electromagnetic force among the inner stator 12, the outer stator 14, and the permanent magnet 16. At the same time, the piston 6 to which the permanent magnet 16 is fixed is linearly-reciprocated in the cylinder 4, and a refrigerant introduced through the suction pipe 30 is introduced into the compression space P between the cylinder 4 and the cylinder 6 by a pressure difference. Then, the refrigerant is compressed, passes through the discharge valve assembly 20, and flows along the loop pipe 28 thereby to be discharged to the discharge pipe 31.

At this time, even if vibration generated as the piston 6 is linearly-reciprocated in the cylinder 4 is transmitted from one side of the loop pipe 28 to another side, the vibration is reduced by the connection unit 52, 54, and 56.

More concretely, since the connection unit is installed to connect the first point of the loop pipe 28 to the second point of the loop pipe 28 adjacent to the first point, vibration passing through the first point of the loop pipe 28 can be transmitted to the second point of the loop pipe 28 through various paths including the loop pipe 28 and the connection unit and thereby the vibration is reduced. Also, vibration transmitted to the second point of the loop pipe 28 along the loop pipe 28 has an opposite phase to a phase of vibration transmitted to the second point of the loop pipe 28 along the connection unit, thereby canceling the vibration.

According to this, even if the compressor is operated, vibration is prevented from being transmitted to the entire case 2. Also, even if the loop pipe 28 is connected to the discharge cover 21 positioned at a side of the discharge valve assembly 20 or the discharge pipe 31 positioned at a side of the case 2 by a welding, the connection part therebetween can be prevented from being damaged.

In the vibration reduction structure of the reciprocating compressor according to the present invention, the connection unit is additionally installed to connect the first point of the loop pipe to the second point of the loop pipe adjacent to the first point. According to this, vibration generated as the piston is operated can be transmitted to the compressor through many paths including the loop pipe and the additional connection unit. Also, generated vibration can be canceled to each other due to its phase difference, thereby preventing vibration from being transmitted to the entire case. Also, a damage of the connection part of the loop pipe due to vibration can be prevented, and a reliability of the product can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor comprising:

a case having a suction pipe for introducing a refrigerant and a discharge pipe for discharging a refrigerant at both sides thereof;

a cylinder installed in the case;

a piston linearly-reciprocated in the cylinder and forming a compression space, for introducing a refrigerant into the compression space in an axial direction and compressing the refrigerant;

a driving unit for linearly-reciprocating the piston;

a discharge valve assembly installed at an end of the compression space of the cylinder to be opened and closed, for discharging a compressed refrigerant;

a loop pipe installed between the discharge valve assembly and the discharge pipe with a curved shape, for preventing vibration generated from die cylinder, the piston, and the driving unit from being transmitted to the case; and a nonelastic connection unit for connecting a first point of the loop pipe and a second point of the loop pipe facing the first point and thereby reducing a vibration transmission, wherein the nonelastic connection unit includes a nonelastic vibration transmitting element configured to transmit vibration from the first point to the second point of the loop pipe, and wherein the nonelastic connection unit is installed completely to wind the first point of the loop pipe and the second point of the loop pipe multiple times at multiple locations along a predetermined length of the first and second points of the loop pipe.

2. The compressor of claim 1, wherein the nonelastic connection unit comprises a plurality of nonelastic connection units.

3. The compressor of claim 1, further comprising a second nonelastic connection unit including a hook at both ends thereof so that one end thereof can be hooked at a third point of the loop pipe and another end thereof can be booked at a fourth point of the loop pipe.

4. The compressor of claim 3, wherein the hook of said one end of the nonelastic connection unit is formed to wind the first point of the loop pipe in a forward direction, and the hook of said another end of the nonelastic connection unit is formed to wind the second point of the loop pipe in a backward direction such that the vibration is transmitted from the first point to the second point of the loop pipe.

5. The compressor of claim 4, wherein the nonelastic connection unit comprises a plurality of nonelastic connection units.

6. The compressor of claim 1, further comprising an elastic connection unit including a coil spring having one end hooked at a third point of the loop pipe and another end hooked at a fourth point of the loop pipe.

7. The compressor of claim 1, wherein the nonelastic connection unit does not overlap when the nonelastic connection winds the loop pipe.

8. The nonelastic connection unit of claim 1, wherein the nonelastic connection unit is a nonelastic wire winding the first point of the loop pipe and the second point of the loop pipe multiple times.

9. The nonelastic connection unit of claim 3, wherein the nonelastic connection unit is a rod with the hook at the both ends of the rod.

* * * * *